US006629756B2

(12) United States Patent
Wang et al.

(10) Patent No.: US 6,629,756 B2
(45) Date of Patent: Oct. 7, 2003

(54) INK JET PRINTHEADS AND METHODS THEREFOR

(75) Inventors: Qing-Ming Wang, Pittsburgh, PA (US); Carl Edmond Sullivan, Versailles, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 104 days.

(21) Appl. No.: 09/788,479

(22) Filed: Feb. 20, 2001

(65) Prior Publication Data

US 2002/0113846 A1 Aug. 22, 2002

(51) Int. Cl.[7] ..... B41J 2/045
(52) U.S. Cl. ..... 347/68; 347/70
(58) Field of Search ..... 347/68, 65, 70, 347/71, 10, 54; 310/328; 216/27; 29/890.1, 25.35

(56) References Cited

U.S. PATENT DOCUMENTS

| | | | | |
|---|---|---|---|---|
| 4,106,976 A | | 8/1978 | Chiou et al. | 216/27 |
| 4,730,197 A | * | 3/1988 | Raman et al. | 347/10 |
| 4,822,755 A | | 4/1989 | Hawkins et al. | 438/21 |
| 4,961,821 A | | 10/1990 | Drake et al. | 438/21 |
| 5,185,055 A | | 2/1993 | Temple et al. | 216/40 |
| 5,200,768 A | | 4/1993 | Shibaike et al. | 347/68 |
| 5,265,315 A | | 11/1993 | Hoisington et al. | 29/25.35 |
| 5,441,593 A | | 8/1995 | Baughman et al. | 216/27 |
| 5,458,254 A | | 10/1995 | Miyagawa et al. | 216/27 |
| 5,459,501 A | * | 10/1995 | Lee et al. | 347/68 |
| 5,581,861 A | | 12/1996 | Lee et al. | 714/709 |
| 5,604,522 A | | 2/1997 | Miura et al. | 347/70 |
| 5,633,209 A | | 5/1997 | Leedy | 216/2 |
| 5,637,189 A | | 6/1997 | Peeters et al. | 438/466 |
| 5,658,471 A | | 8/1997 | Murthy et al. | 216/27 |
| 5,808,781 A | | 9/1998 | Arney et al. | |
| 5,853,601 A | | 12/1998 | Krishaswamy et al. | 216/2 |
| 5,871,656 A | | 2/1999 | Silverbrook | 216/27 |
| 5,922,218 A | | 7/1999 | Miyata et al. | 216/27 |
| 5,945,260 A | | 8/1999 | Miyagawa et al. | 430/320 |
| 5,972,781 A | | 10/1999 | Wegleiter et al. | 438/460 |
| 5,980,025 A | * | 11/1999 | Burke et al. | 29/890.1 |

(List continued on next page.)

FOREIGN PATENT DOCUMENTS

JP 403092355 A 4/1991

*Primary Examiner*—Lamson Nguyen
*Assistant Examiner*—K. Feggins
(74) *Attorney, Agent, or Firm*—David LaRose; Jacqueline M. Daspit; John A. Brady

(57) ABSTRACT

The invention provides a method for making piezoelectric printheads for ink jet The method includes applying an insulating layer to a first surface of a silicon wafer having a thickness ranging from about 200 to about 800 microns. A first conducting layer is applied to the insulating layer on the first surface and a piezoelectric layer is applied to the first conducting layer. The piezoelectric layer is patterned to provide piezoelectric elements on the first surface of the silicon wafer. A second conducting layer is applied to the piezoelectric layer and is patterned to provide conductors for applying an electric field across each of the piezoelectric elements. A photoresist layer is applied to a second surface of the silicon wafer, and the photoresist layer is imaged and developed to provide pressurizing chamber locations. The silicon wafer is then dry etched through the thickness of the wafer up to the insulating layer on the first surface of the wafer. A nozzle plate containing nozzle holes corresponding to the pressurizing chambers is applied and bonded to the second surface of the silicon wafer. As opposed to conventional wet chemical etching techniques, the method of the invention significantly decreases the manufacturing tolerances required and provides more reliable printheads for long term printer use.

29 Claims, 5 Drawing Sheets

U.S. PATENT DOCUMENTS 6,019,458 A * 2/2000 Shimada et al. ..... 347/70
6,022,752 A 2/2000 Hirsh et al. ..... 438/21
6,126,279 A 10/2000 Shimada et al. ..... 347/70
6,232,135 B1 5/2001 Ashe et al. ..... 438/21
6,234,608 B1 * 5/2001 Genovese et al. ..... 347/54
6,280,642 B1 * 8/2001 Ikeda et al. ..... 216/27
6,294,317 B1 9/2001 Calistri-Yeh et al. ..... 430/320
6,347,860 B1 * 2/2002 Choi ..... 347/54
6,431,689 B1 * 8/2002 Schippers ..... 347/65

* cited by examiner

INK JET PRINTHEADS AND METHODS THEREFOR

FIELD OF THE INVENTION

The invention is directed to printheads for ink jet printers and more specifically to improved printhead structures and methods for making the structures.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or printhead itself. Printheads may be classified in several categories which include thermal printheads and piezoelectric printheads. Thermal printheads eject ink by superheating a component in the ink thereby forming a vapor bubble which forces ink through a nozzle hole onto print media. Piezoelectric printheads operate by forming pressure pulses in a pressurizing chamber containing ink using a piezoelectric film adjacent one wall of the chamber. Activation of the piezoelectric film causes a pulsation of a pressurizing chamber wall thereby forcing ink out of a nozzle hole adjacent the pressurizing chamber.

A piezoelectric ink jet printhead includes a pressurizing chamber substrate and a nozzle substrate bonded to the pressurizing chamber substrate. The pressurizing chamber substrate is typically made from a monocrystalline silicon material having a thickness ranging from about 100 to about 800 microns. An oscillating plate film, lower electrode, piezoelectric film and upper electrode are formed on the silicon substrate opposite the pressurizing chamber side of the substrate. The pressurizing chambers are conventionally formed by a wet chemical etching process by etching into the thickness dimension of the silicon substrate.

Wet chemical etching techniques provide suitable dimensional control for etching of relatively thin semiconductor chips. Methods for wet chemical etching silicon to produce pressurizing chambers are described for example in U.S. Pat. No. 5,265,315 to Hoisington et al. However, wet chemical etching is highly dependent on the thickness of the silicon chip and the concentration of the etchant which results in variations in etch rates and etch tolerances. The resulting etch pattern for wet chemical etching must be at least as wide as the thickness of the wafer. Wet chemical etching is also dependent on the silicon crystal orientation and any misalignment relative to the crystal lattice direction can affect dimensional control. Mask alignment errors and crystal lattice registration errors may result in significant total errors in acceptable product tolerances. Accordingly, wet chemical etching is not practical for relatively thick silicon substrates because the entrance width is equal to the exit width plus the square root of 2 times the substrate thickness. However, it is desirable to use standard silicon wafers which are relatively thick. Obtaining thinner silicon wafers increases the costs of the product due to the non-standard thickness.

Other problems associated with wet chemical etching include, undercutting of the pressurizing chambers, especially when forming deep trench structures. It becomes extremely difficult, if not impossible, to form well defined, sharp and high-aspect ratio trench structures by a wet chemical etching process. In addition, the toxicity of the wet chemical etchant also poses environmental problems and extreme caution must be exercised when handling the wet etchant chemicals. A boron-diffused layer is desirably used as an etch-stop layer for wet chemical etching of the silicon substrate. However, providing a boron-diffused layer requires well controlled diffusion techniques which substantially increases the cost of printhead construction.

Despite their seeming simplicity, printhead devices described above are microscopic marvels containing electrical circuits, ink passageways and a variety of tiny parts assembled with precision to provide a powerful, yet versatile component of the printer. The printhead components must cooperate with an endless variety of ink formulations to provide the desired print properties. Accordingly, it is important to match the printhead components to the ink and the duty cycle demanded by the printer. Slight variations in production quality can have a tremendous influence on the product yield and resulting printer performance.

As advances are made in print quality and speed, a need arises for an increased number of pressurizing chambers and associated nozzle holes which are more closely spaced on the silicon substrates. Decreased spacing between the nozzles and pressurizing chambers requires more reliable manufacturing techniques and manufacturing techniques having lower tolerances. As the complexity of the printheads continues to increase, there is a need for long-life printheads which can be produced in high yield while meeting the more demanding manufacturing tolerances. Thus, there continues to be a need for improved manufacturing processes and techniques which provide improved printhead components.

SUMMARY OF THE INVENTION

With regard to the above and other objects the invention provides a method for making piezoelectric printheads for ink jet printers. The method includes applying an insulating layer to a first surface of a silicon wafer having a thickness ranging from about 200 to about 800 microns. A first conducting layer is applied to the insulating layer on the first surface and a piezoelectric layer is applied to the conducting layer. The piezoelectric layer is patterned to provide piezoelectric elements on the first surface of the silicon wafer. A second conducting layer is applied to the piezoelectric layer and is patterned to provide conductors for applying an electric field across each of the piezoelectric elements. A photoresist layer is applied to a second surface of the silicon wafer, and the photoresist layer is imaged and developed to provide pressurizing chamber locations. The silicon wafer is then dry etched through the thickness of the wafer up to the insulating layer on the first surface of the wafer. A nozzle plate containing nozzle holes corresponding to the pressurizing chambers is applied and bonded to the second surface of the silicon wafer.

In another aspect the invention provides a piezoelectric printhead for an ink jet printer. The printhead includes a silicon wafer having a thickness ranging from about 200 to about 800 microns, a first surface and a second surface. The first surface contains an insulating layer, conducting layer, piezoelectric layer and electrical contact layer and the second surface optionally contains a passivation layer. A plurality of pressurizing chambers having substantially vertical walls are dry etched in the silicon wafer through the passivation layer on the second surface up to the insulating layer on the first surface. A nozzle plate containing nozzle holes corresponding to each of the pressurizing chambers is attached to the second surface of the silicon wafer.

An advantage of the invention is that pressurizing chambers and ink vias may be formed in a relatively thick semiconductor silicon chip with substantially consistent tolerances to provide improved ink flow characteristics as compared to printheads made using wet chemical etching techniques. Deep reactive ion etching (DRIE) and inductively coupled plasma (ICP) etching, referred to herein as "dry etching", provide advantages over wet chemical etching techniques because the etch rate is not dependent on silicon thickness or crystal lattice orientation and thus undercutting of the pressurizing chambers is greatly reduced. Dry etching techniques are also adaptable to producing a larger number of pressurizing chambers which may be more closely spaced together than pressurizing chambers made with conventional wet chemical etching processes. The dry etching techniques of the invention also avoid the use of highly corrosive chemicals for producing high aspect ratio, relatively deep fluid flow structures in silicon wafers.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
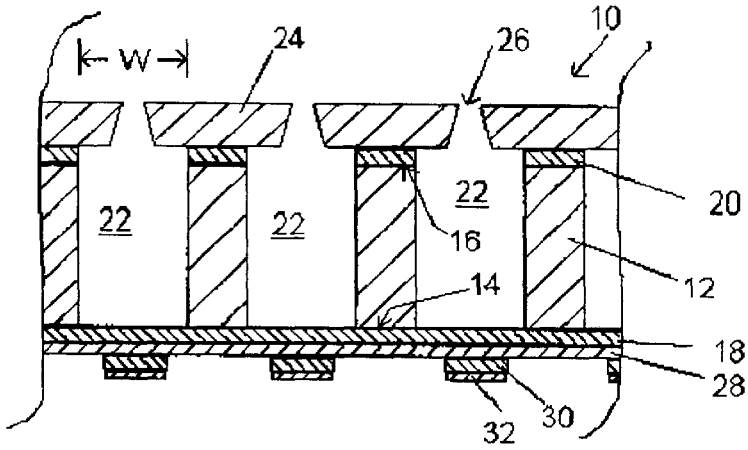
FIGS. 1 and 2 are cross-sectional side and end views, not to scale, through portions of a printhead made according to the invention.
Figure 2:
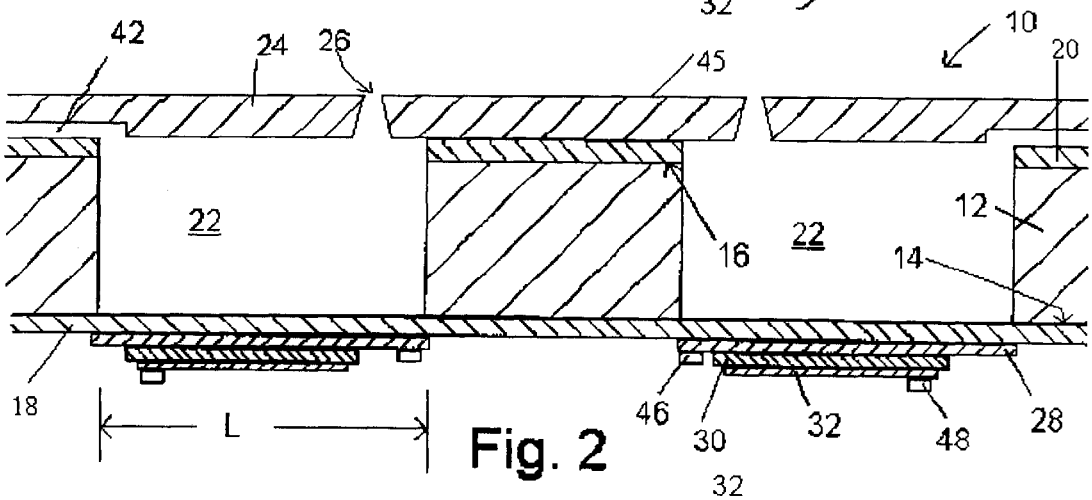

With reference to FIGS. 1 and 2, the invention provides a piezoelectric printhead 10 containing a silicon body section 12 having first and second surfaces 14 and 16. The surfaces 14 and 16 include a passivation layer 18, also referred to as an insulating layer 18, and an optional passivation layer 20 thereon. As described in more detail below, a photoresist layer rather than or in addition to passivation layer 20 is applied to the second surface 16 of the silicon body section 12 prior to etching the silicon body section 12. The photoresist layer is patterned to provide pressurizing chamber locations for pressurizing chambers 22 and is preferably removed before attaching nozzle plate 24 containing nozzle holes 26 to the body section 12. Pressurizing chambers 22 are dry etched in the silicon body section 12 in accordance with the location of piezoelectric devices 30. The nozzle plate 24 is adhesively attached to passivation layer 20 or directly to surface 16 of the body section 12. The passivation layer 18 opposite the nozzle plate 24 contains a common conducting layer 28, piezoelectric devices 30 and top conducting layers 32. The conducting layers 28 and 32 provide a path for electrical imput pulses to the piezoelectric devices 30. A patterned passivation layer may be applied over the piezoelectric devices 30 to insulate the piezoelectric devices 30 and to protect the devices 30 during the pressurizing chamber 22 etching process. The patterned passivation layer over the piezoelectric devices 30 is provided with openings for electrical connection to the conducting layers 28 and 32.

During a printing operation, electrical impulses are applied to one or more of the piezoelectric devices 30 causing flexing of the passivation layer 18 and conducting layer 28 below the piezoelectric layer 30 as seen in FIGS. 1 and 2. The passivation layer 18 and conducting layer 28 flex into pressurizing chambers 22 a distance sufficient to pressurize the ink in chambers 22 and urge pressurized ink through nozzle holes 26. The combined thickness of the passivation layer 18 and conducting layer 28 preferably ranges from about 3 to about 10 microns.

The volume of the pressurizing chambers 22 is related to the amount of ink ejected during activation of the piezoelectric devices 30. It is therefore important for the pressurizing chambers 22 to be made with exacting tolerances. Slight variations in the tolerances of the pressurizing chambers 22 may result in reduced print quality, cross-talk between pressurizing chambers 22 and/or nozzle 26 failure.

Figure 3A:
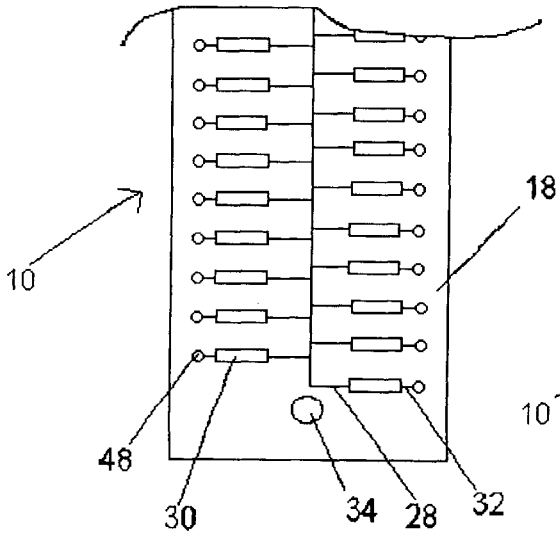
FIGS. 3A and 3B are plan views from a device side of silicon body sections for printheads according to the invention.
Figure 3B:
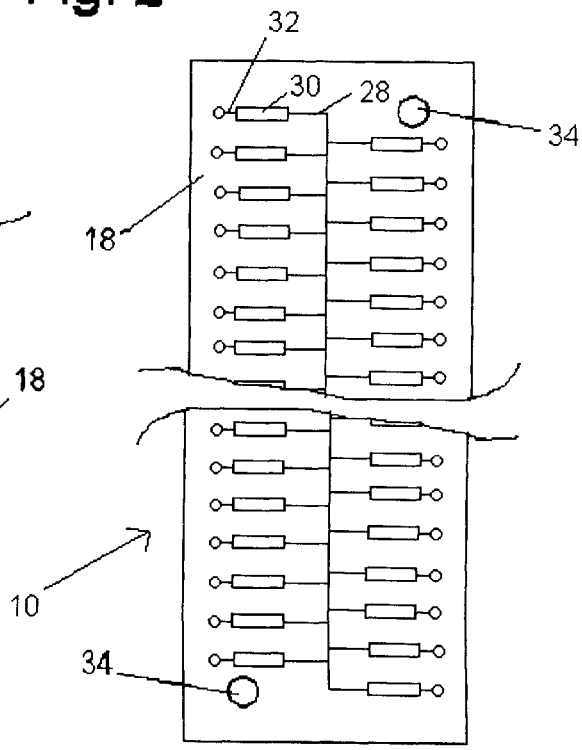
Figure 4A:
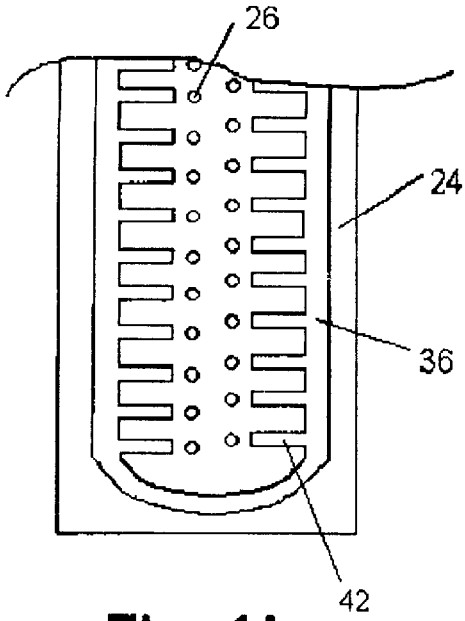
FIGS. 4A and 4B are plan views from a silicon body section side of nozzle plates for printheads according to the invention.
Figure 4B:
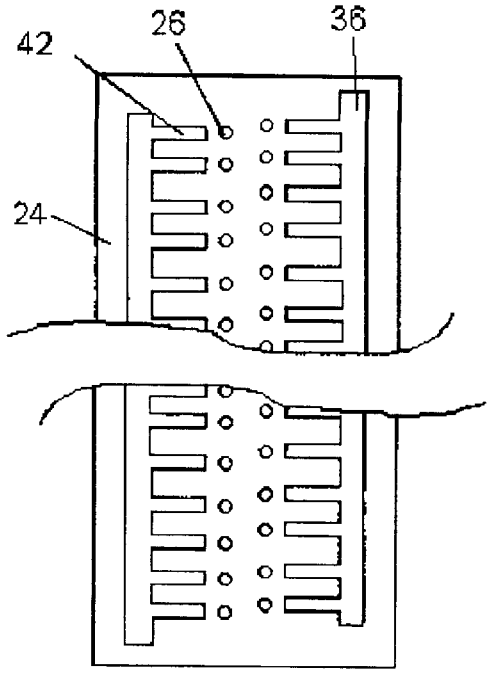
Figure 5:
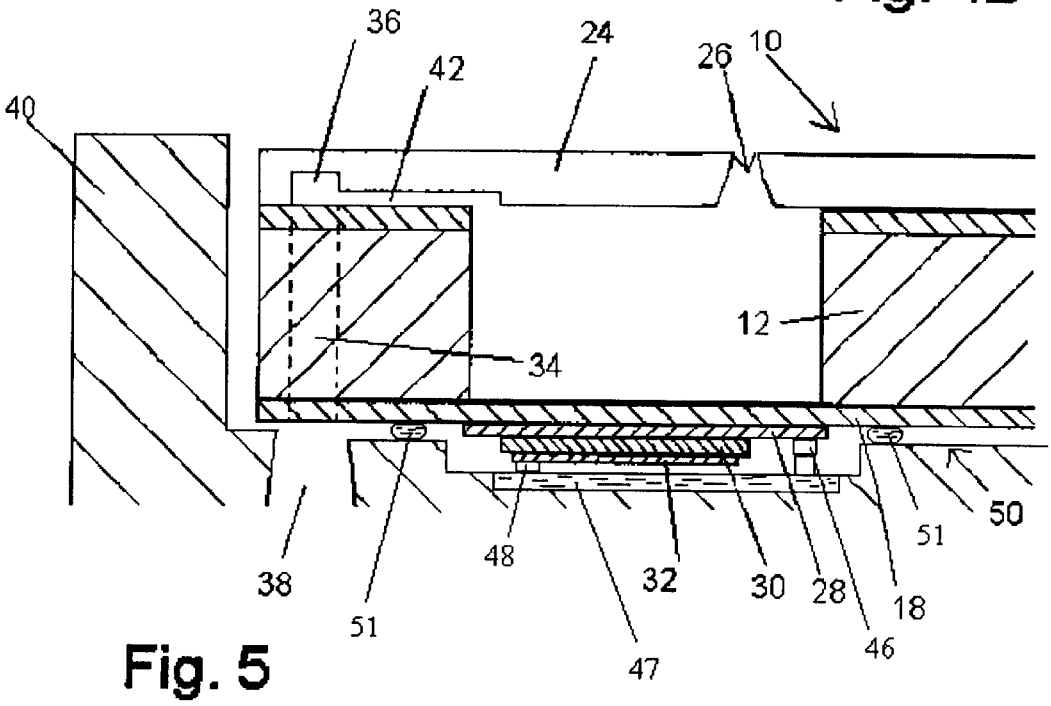
FIG. 5 is a cross-sectional view, not to scale of a portion of a printhead and printhead carrier according to the invention.

A printhead 10 preferably contains a plurality of pressurizing chambers 22 and associated piezoelectric devices 30. Views of portions of printheads 10 from the device side thereof are shown in FIGS. 3A and 3B. FIGS. 3A and 3B are alternative designs for the location of ink feed vias 34 through the silicon body sections 12. The alternate locations of the ink feed vias 34 correspond to ink reservoirs 36 disposed in the nozzle plate 24 as seen in FIGS. 4A and 4B. The ink reservoirs 36 conduct ink from an ink supply through ink supply channels 38 in a printhead carrier 40 (FIG. 5). The printhead carrier 40 contains one or more pockets or wells 50 for attaching one or more printheads thereto (FIG. 5). Ink flow channels 42 corresponding to the pressurizing chambers 22 and nozzle holes 26 are formed in the nozzle plate 24 and are in flow communication with the ink reservoirs 36 as shown in FIGS. 4A and 4B.

Figure 6:
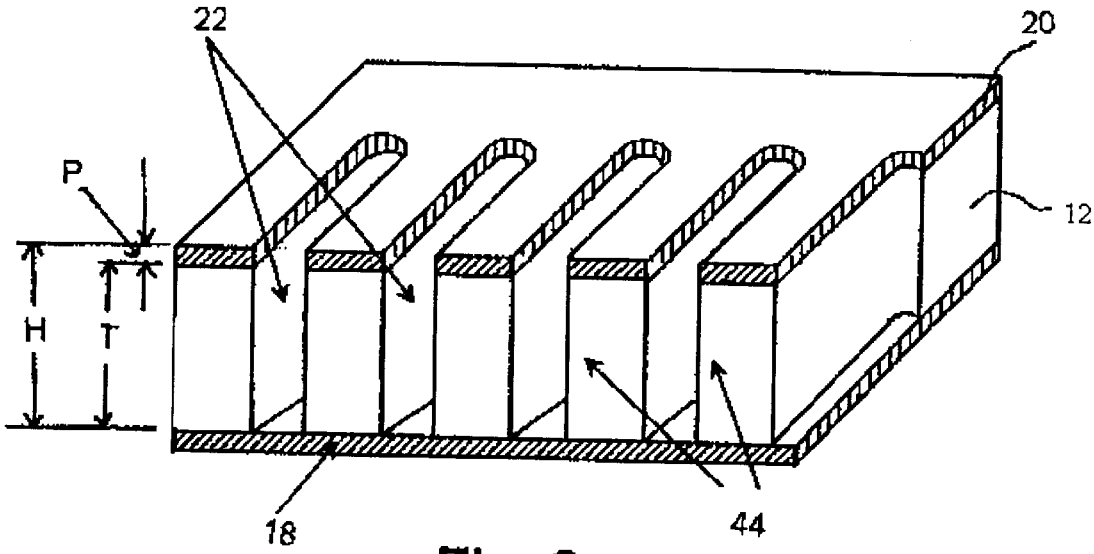
FIG. 6 is a perspective view of a portion of a printhead showing pressurizing chambers made in a silicon body section according to the invention.

A preferred profile of the pressurizing chambers 22 made according to the invention may be seen by reference to FIG. 6. As described in more detail below, the pressurizing chambers 22 are etched through passivation layer 20 and through the thickness of the silicon body section 12 up to passivation layer 18 so that a plurality of individual pressurizing chambers 22 are formed. Walls 44 between each pair of pressurizing chambers 22 are preferably substantially vertical with respect to the plane of the passivation layers 18 or 20. Walls 44 preferably have a thickness ranging from about 50 to about 200 microns between adjacent pressurizing chambers 22. The chambers 22 also have a high aspect ratio, that is, the depth of the pressurizing chambers 22 is much greater than the width of the chambers 22. For example, the pressurizing chambers preferably have a depth ranging from about 190 to about 795 microns depending on the thickness of the silicon body section 12. It is also preferred that the chambers 22 be etched completely through the thickness of the silicon body section 12 up to passivation layer 18 on the first surface 14 of body section 12. Accordingly, for a silicon body section 12 having a thickness dimension T ranging from about 100 to about 800 microns, it is preferred that chambers 22 have a height H of from about 90 to about 100% of T plus the thickness P of the passivation layer 20. Passivation layers 18 and 20 preferably having a thickness P ranging from about 0.1 to about 10 microns, preferably from about 0.5 to about 5 microns.

The width W of the pressurizing chambers 22 (FIG. 1) is relatively narrow. Accordingly, the pressurizing chambers 22 each preferably have a width W ranging from about 50 to about 200 microns. The length L of each pressurizing chamber (FIG. 2) preferably ranges from about 1 mm to about 5 mm. Pressurizing chambers 22 made by conventional wet chemical etching techniques typically have chamber dimensions of about 75 to about 200 microns wide by about 3 to about 6 mm long in 100 micron thick silicon wafer depending on the lattice orientation of the silicon wafer. Because of crystal lattice orientation, it is difficult to closely control the dimensions of pressurizing chambers using wet etching techniques in silicon substrates much thicker than about 100 to about 150 microns. If (110) silicon wafer is wet chemical etched, substantially vertical chamber walls may be produced. However, wet chemical etching techniques often produce undercut structures making it difficult to maintain close tolerance between the chambers 22. In contrast to wet chemical etching, the present invention provides a method for controlling the manufacturing of pressurizing chambers in relatively thick silicon substrates, e.g., silicon thickness' ranging from about 200 to about 800 microns or more regardless of the crystal lattice orientation with respect to etching.

The overall dimensions of the silicon body section 12 of the printhead 10 is relatively small in size. The silicon body section 12 typically has overall dimensions ranging from about 10 to about 30 millimeters wide by about 10 to about 30 millimeters long. Because higher manufacturing tolerances must be provided between the pressurizing chambers to allow for variances for wet chemically etching techniques, an overall larger silicon body section 12 for the same size and number of pressurizing chambers 22 is generally required for printheads made by wet chemical etching techniques as compared to the same printheads made by the dry etching techniques of the invention.

Figure 7:
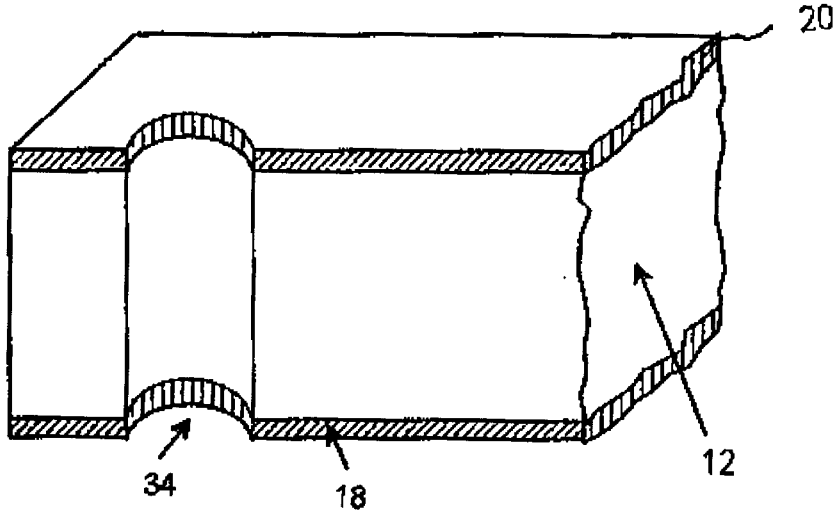
FIG. 7 is a perspective view of a portion of a printhead showing an ink feed via made in a silicon body section according to the invention.

In addition to the pressurizing chambers 22, ink feed vias 34 (FIGS. 3A and 3B and FIG. 7) are also preferably dry etched through the entire thickness of the silicon body section 12. In the case of ink feed vias 34, openings are provided through both passivation layers 18 and 20 (if provided) so that the ink feed vias 34 are in ink flow communication with ink supplied from an ink supply container, ink cartridge or remote ink supply. The ink feed vias 34 direct ink from the ink supply source through the silicon body section 12, ink reservoirs 36 and ink flow channels 42 in the nozzle plate 24 or silicon body section 12 for flow to pressurizing chambers 22 (FIGS. 4A, 4B and 5).

As seen in FIGS. 1 and 2, a single pressurizing chamber 22 is associated with a single piezoelectric device 30 disposed on a common conducting layer 28 and passivation layer 18 adjacent the pressurizing chamber 22. Accordingly, there are as many piezoelectric devices 30 as pressurizing chambers 22 on the printhead 10. There are also one or more ink feed vias 34 through the silicon body section 12 associated with the pressurizing chambers 22 and piezoelectric devices 30 to provide ink to the pressurizing chambers 22.

With reference again to FIGS. 1 and 2, the printhead 10, seen in cross-section, not to scale, includes silicon body section 12 having etch stop layer or passivation layer 18 of silicon dioxide ($SiO_2$), silicon nitride or silicon carbide disposed on surface 14 thereof. The opposing surface 16 of the silicon body section 12 may contain passivation layer 20 made of silicon dioxide ($SiO_2$), silicon nitride or silicon carbide, or if a photoresist material is applied directly to the second surface 16, the photoresist material is removed after etching the pressurizing chambers 22. As described in more detail below, a portion of the layer 20 (if present) is etched or patterned during the manufacturing process for the printhead to define the location of the pressurizing chambers 22. The conducting layer 28, piezoelectric layer 30 and top conducting layer 32 are formed on passivation layer 18 by thin film deposition techniques such as sol-gel spin-on coating, sputtering, etc. Alignment between the piezoelectric devices 30 and the pressurizing chamber 22 locations is provided by double-side alignment using cameras or by infrared alignment techniques well known by those skilled in the art.

The piezoelectric layer 30 is sandwiched between common conducting layer 28 and top conducting layer 32. The piezoelectric layer 30 is provided by a material selected from the group consisting of lead zirconate titanate, lead magnesium niobate-lead titanate, lead nickel niobate-lead titanate, lead zinc niobate-lead titanate solid solutions. The common conducting layer 28 is provided by a material selected from the group consisting of titanium and/or platinum and the top conducting layer 32 is provided by a material selected from the group consisting of platinum, aluminum, copper or any other conducting material. A preferred conducting layer 32 is a platinum/titanium layer 28 which is deposited over a silicon dioxide layer 18 on silicon 12.

After the steps of forming the pressurizing chambers 22, ink feed vias 36 and depositing the piezoelectric layer 30, conducting layer 28 and top conducting layer 32 on the passivation layer 18, a nozzle plate 24 is adhesively attached directly to surface 16 of the silicon body section 12 or to passivation layer 20 (if present) such as with a UV-curable or heat curable epoxy adhesive material. The adhesive used to attach the nozzle plate 24 to the body section 12 or passivation layer 20 is preferably a heat curable adhesive such as a B-stageable thermal cure resin, including, but not limited to phenolic resins, resorcinol resins, epoxy resins, ethylene-urea resins, furane resins, polyurethane resins and silicone resins. The adhesive used to attach the nozzle plate 24 to the passivation layer 20 preferably has a thickness ranging from about 1 to about 25 microns. A particularly preferred adhesive is a phenolic butyral adhesive which is cured by heat and pressure.

The nozzle plate 24 contains a plurality of the nozzle holes 26 each of which are in fluid flow communication with a pressurizing chamber 22. The nozzle plate 24 is made of a material selected from metal such as nickel or a polymeric material such as a polyimide available from Ube Industries, Ltd of Tokyo, Japan under the trade name UPILEX. A preferred material for the nozzle plate 24 is a polymeric material and the nozzle holes 26 are made such as by laser ablating the polymeric material. A particularly preferred nozzle plate material is polyimide which may contain an ink repellent coating on surface 45 thereof (FIG. 2).

The nozzle plate 24 and pressurizing chambers 22 are preferably aligned optically so that each nozzle hole 26 in the nozzle plate 24 aligns with one of the pressurizing chambers 22. Misalignment between the nozzle holes 26 and the pressurizing chambers 22 may cause problems such as misdirection of ink droplets from the printhead 10, inadequate droplet volume or insufficient droplet velocity. Accordingly, nozzle plate/pressurizing chamber assembly 24/22 alignment is critical to the proper functioning of an ink jet printhead.

After the nozzle plate 24 has been attached to the second surface 16 or passivation layer 20 on silicon body section 12, the common conducting layer 28 and top conducting layer 32 may be electrically connected to a flexible circuit or TAB circuit 47 (FIG. 5). Connection between the conducting layers 28 and 32 and TAB circuit 47 may be accomplished by use of a TAB bonder or wires to connect traces on the flexible or TAB circuit 47 with connection pads 46 and 48 on common conducting layer 28 and top conducting layer 32, respectively.

As seen in FIG. 5, the printhead 10 is attached in a chip pocket 50 to a printhead carrier or cartridge body 40. A die bond adhesive 51 is preferably used to attached the printhead 10 to the printhead carrier or cartridge body 40, preferably an epoxy adhesive 51 such as a die bond adhesive available from Emerson & Cuming of Monroe Township, N.J. under the trade name ECCOBOND 3193-17. In the case of a thermally conductive chip carrier or cartridge body 40, the die bond adhesive 51 is preferably a resin filled with thermal conductivity enhancers such as silver or boron nitride. A preferred thermally conductive die bond adhesive is POLY-SOLDER LT available from Alpha Metals of Cranston, R.I. A suitable die bond adhesive 51 containing boron nitride fillers is available from Bryte Technologies of San Jose, Calif. under the trade designation G0063. The thickness of die bond adhesive 51 preferably ranges from about 25 microns to about 125 microns. Heat is typically required to cure die bond adhesive 51 and fixedly attach the printhead 10 to the printhead carrier or cartridge body 40. It is preferred that the adhesive 51 and/or other encapsulant material be used to seal the TAB circuit 47, conducting layers 28 and 32, piezoelectric device 30, connection pads 46 and 48 from corrosion from ink.

Prior to the printhead 10 being attached to the printhead carrier or cartridge body 40, the flexible circuit or TAB circuit 47 may be attached to the printhead carrier or cartridge body 40 using a heat activated or pressure sensitive adhesive. Preferred pressure sensitive adhesives include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. The adhesive preferably has a thickness ranging from about 25 to about 200 microns.

In order to control the ejection of ink from the nozzle holes, it is preferred that each piezoelectric device 30 be electrically connected to a print controller in the printer to which the printhead 10 is attached. Connections between the print controller and the piezoelectric device 30 of printhead 10 are provided by electrical traces which terminate in connection pads 46 and 48 on conducting layers 28 and 32. Electrical TAB bond or wire bond connections are made between the flexible circuit or TAB circuit 47 and the connection pads on the conducting layers 28 and 32.

Figure 8A:
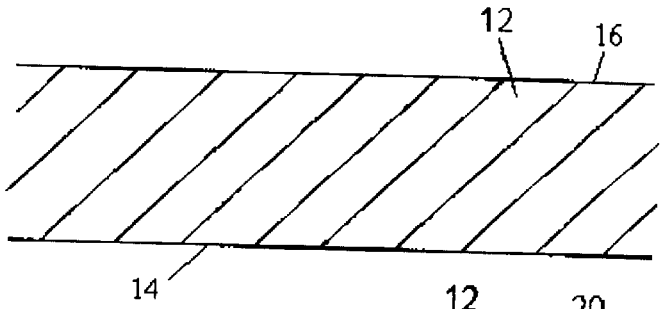
FIGS. 8A–8J are partial cross-sectional views of silicon body sections, not to scale, illustrating a sequence for making printheads according to the invention.
Figure 8B:
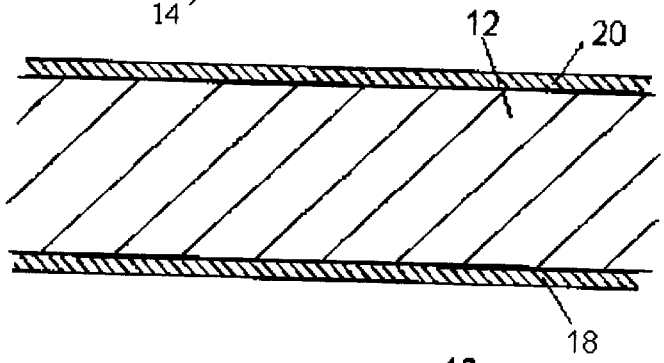

With reference to FIGS. 8A–8J, a preferred method for making printhead 10 will now be described. A silicon wafer providing silicon body section 12 is shown in FIG. 8A. In order to facilitate dry etching of the silicon body section 12, body section 12 is preferably coated with passivation layer 18 and, optional passivation layer 20 as seen in FIG. 8B. The passivation layers 18 and 20 may be selected from $SiO_2$, a photoresist material, metal and metal oxides, i.e., tantalum, tantalum oxide and the like. In the case of $SiO_2$ passivation layers 18 and 20, the passivation layers 18 and 20 are preferably applied to the silicon body section 12 by a thermal growth method, sputtering or spin-coating.

The passivation layers 18 and 20 are relatively thin compared to the thickness of the silicon body section 12 and will generally have a silicon body section 12 to passivation layer 18 and 20 thickness ratio ranging from about 30:1 to about 800:1. Accordingly, for a silicon body section 12 having a thickness ranging from 200 to about 800 microns, the thickness of layers 18 and 20 may range from about 0.1 to about 10 microns. When a photoresist layer is applied directly to surface 16 of the silicon body section 12, the photoresist layer has a thickness ranging from about 1 to about 30 microns, preferably from about 3 to about 20 microns thick.

Figure 8C:
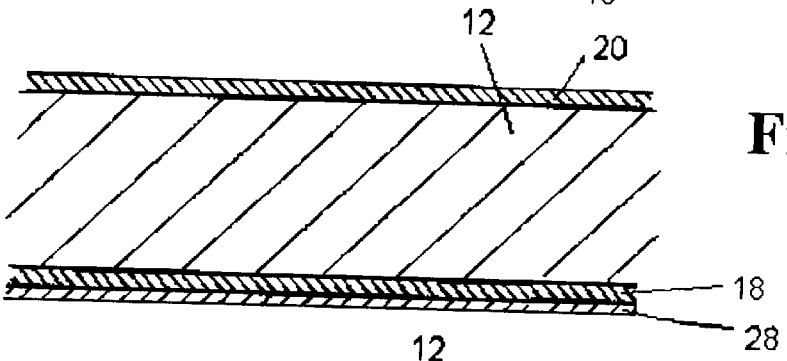
Figure 8D:
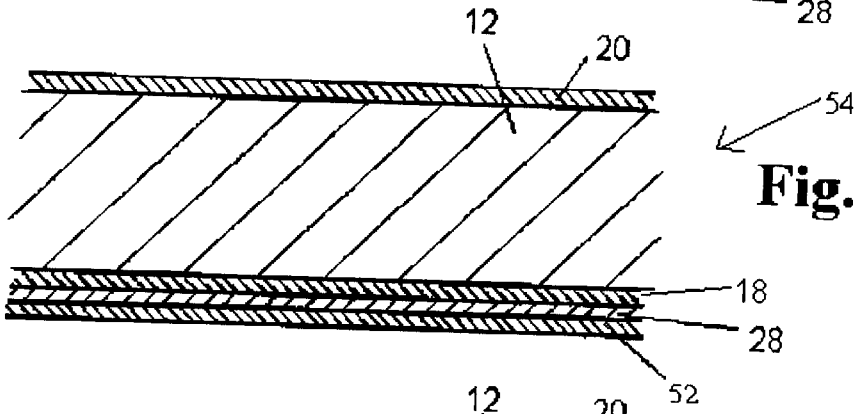

A conducting layer 28, preferably including titanium and platinum and a piezoelectric layer 52, preferably a piezoelectric lead zirconate titanate (PZT) ceramic layer, are applied to the passivation layer 18 (FIGS. 8C and 8D). The passivation layer 18 acts as an etch stop layer and as a supporting layer for the conducting layer 28 and PZT layer 52. The conducting layer 28 may be sputtered on the passivation layer 18 to provide a ground plane for an electric circuit for the PZT layer 52. Conducting layer 28 preferably has a thickness ranging from about 0.15 to about 1.0 micron, most preferably from about 0.5 to about 1 micron.

The PZT layer 52 is deposited on the conducting layer 28 as by a sol-gel spin-on coating technique or by a sputtering technique. PZT layer 52 preferably has a thickness ranging from about 1 to about 10 microns, preferably from about 2 to about 10 microns. FIG. 8D illustrates structure 54 prior to patterning the individual piezoelectric devices 30.

Figure 8E:
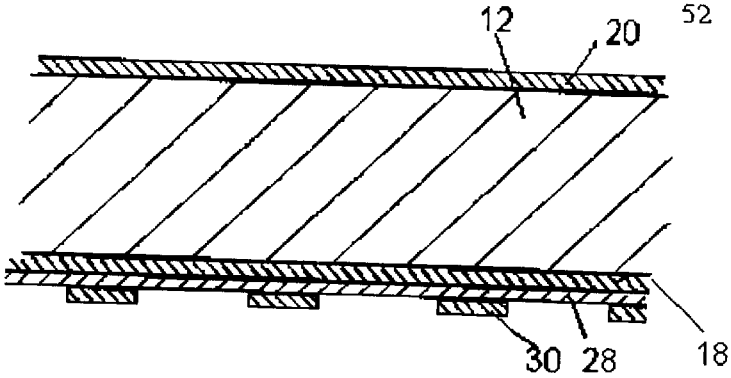

In FIG. 8E, the PZT layer 52 has been patterned to define individual piezoelectric devices 30. Patterning of the PZT layer 52 may be conducted such as by ion beam milling, reactive ion etching, wet chemical etching using a buffered oxide etchant, etc. Each piezoelectric device 30 preferably has dimensions similar to the length and width dimensions of the pressurizing chamber 22 corresponding to the piezoelectric device 30. Accordingly, each piezoelectric device 30 has dimensions of from about 50 to about 200 microns wide by from about 1 to about 5 mm long.

Figure 8F:
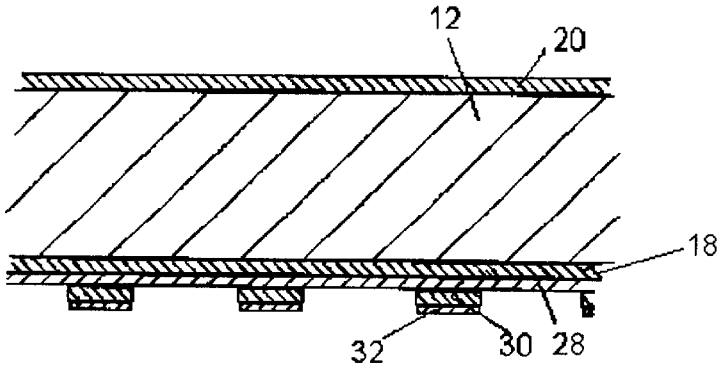

A top conducting layer 32 is then sputtered on top of the individual piezoelectric devices 30 (FIG. 8F). The top conducting layer 32 preferably has a thickness ranging from about 0.15 to about 1.0 micron. In order to define contact with the individual piezoelectric devices 30, the top conducting layer 32 is patterned as by ion beam milling or reactive ion etching. A portion of the top conducting layer 32 terminates in contact pads 48 for connection to the flexible circuit or TAB circuit 47 of a printer for applying an electric field across the piezoelectric devices 30 (FIG. 2). In the alternative, the PZT layer 52 and top conducting layer 32 may be patterned at essentially the same time to define the piezoelectric devices 30 and the top conducting layer 32 as shown in FIG. 8F.

After forming the piezoelectric devices 30 and providing conducting layer 32 on piezoelectric devices 30, the pressurizing chambers 22 are formed. A preferred method for forming pressurizing chambers 22 and ink feed vias 34 in a silicon body section 12 is a dry etch technique selected from deep reactive ion etching (DRIE) and inductively coupled plasma (ICP) etching which is described with reference to FIGS. 8G–8J. Both techniques employ an etching plasma comprising an etching gas derived from fluorine compounds such as sulfur hexafluoride ($SF_6$), tetrafluoromethane ($CF_4$) and trifluoroamine ($NF_3$). A particularly preferred etching gas is $SF_6$. A passivating gas is also used during the etching process. The passivating gas is derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof. A particularly preferred passivating gas is $C_4F_8$.

Figure 8G:
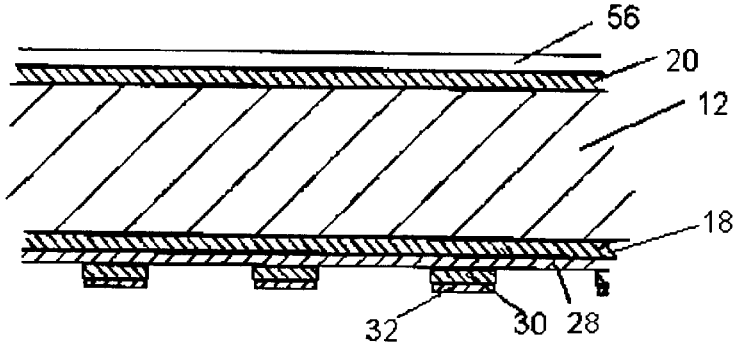
Figure 8H:
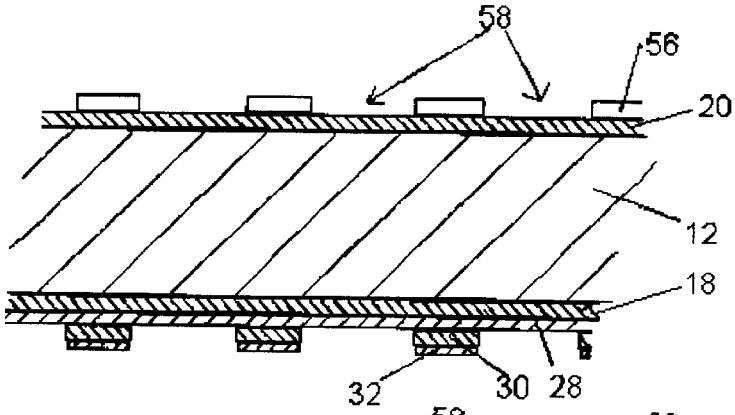
Figure 8I:
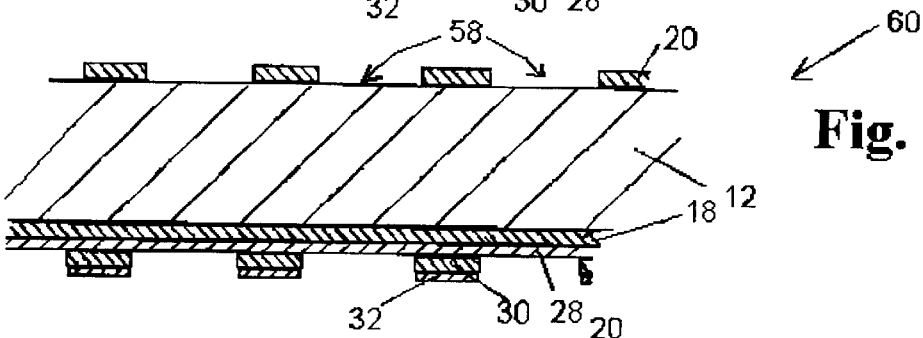

In the alternative, the pressuring chambers 22 may be patterned and formed in the silicon body section 12 prior to forming the piezoelectric devices 30 set forth in FIGS. 8A–8F. In this case, the pressurizing chamber locations in the silicon body section 12 may be patterned in the body section 12 from either side of the body section 12 thereof, the opposite side being provided with an etch stop material such as passivation layer 20 or passivation layer 18. However, it is preferred to form the piezoelectric devices 30 prior to forming the pressurizing chambers 22. In this case, a photoresist layer 56 is applied to the second surface 16 of the silicon body section 12 or to passivation layer 20 as shown in FIG. 8G. The photoresist layer 56 is preferably applied with a thickness ranging from about 1 to about 30 microns, most preferably from about 16 to about 20 microns. The photoresist layers 56 is patterned to define the location of the pressurizing chambers 22, for example, by use of an ultraviolet light and a photomask. The pressurizing chamber locations 58 (FIG. 8H) are selected based on the locations of the piezoelectric devices 30 by well known imaging techniques. Photoresist layer 56 is imaged, developed and removed to define the locations 58 for the pressurizing chambers 22. The passivation layer 20 in locations 58 is then etched and removed by wet chemical etching using buffered oxide etchant or by a reactive ion etch technique. The resulting patterned structure 60 is shown in FIG. 8I.

The patterned structure 60 containing passivation layer 18 and partial passivation layer 20 is then placed in an etch chamber having a source of plasma gas and back side cooling such as with helium and water. It is preferred to maintain the patterned structure 60 below about 400° C., most preferably in a range of from about 50° to about 80° C. during the etching process. In the process, a deep reactive ion etch (DRIE) or inductively coupled plasma (ICP) etch of the silicon is conducted using an etching plasma derived from $SF_6$ and a passivating plasma derived from $C_4F_8$ wherein the chip 10 is etched from the patterned location 58 side toward passivation layer 18 which will contains the piezoelectric devices 30. A protection passivation layer may be applied over the conducting layers 28 and 32 and the piezoelectric devices 30 prior to etching the pressurizing chambers 22 in order to protect these layers and devices during the dry etching process.

Figure 8J:
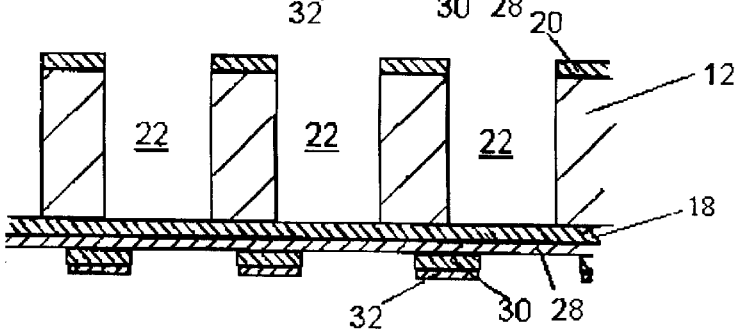

During the etching process, the plasma is cycled between the passivating plasma step and the etching plasma step until the pressurizing chambers 22 are formed completely through the thickness of the silicon body section 12 up to passivation layer 18 as shown in FIG. 8J. Cycling times for each step preferably ranges from about 5 to about 20 seconds for each step. Gas pressure in the etching chamber preferably ranges from about 15 to about 50 millitorrs at a temperature ranging from about −20° to about 35° C. The DRIE or ICP platen power preferably ranges from about 10 to about 25 watts and the coil power preferably ranges from about 800 watts to about 3.5 kilowatts at frequencies ranging from about 10 to about 15 MHz. Etch rates may range from about 2 to about 10 microns per minute or more and produce holes having side wall profile angles ranging from about 88° to about 92°. Etching apparatus is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al. When the passivation layer 18 or etch stop layer $SiO_2$ is reached, etching of the silicon body 12 section terminates.

The same process, described above may be used to form the ink feed vias 34 in the silicon body section 12 and passivation layers 18 and 20, which vias 34 are preferably formed at substantially the same time as the pressurizing chambers 22. The ink feed vias 34 are located in the silicon body section 12 remote from the pressurizing chambers 22 but provide ink flow communication between the pressurizing chambers 22 and the ink supply as described above. Each ink feed via 34 has a diameter ranging from about 200 microns to about 2000 microns and a printhead containing 128 pressurizing chambers 22 may contain from about 1 to about 4 ink feed vias 34. The ink feed vias 34 may also be formed by grit blasting or wet chemical etching techniques. However it is preferred to form the ink feed vias 34 by the DRIE technique described above and preferably during the formation of the pressurizing chambers 22.

As compared to wet chemical etching, the dry etching techniques according to the invention may be conducted independent of the crystal orientation of the silicon body section 12 and thus etched structures may be placed more accurately in body section 12. While wet chemical etching is suitable for silicon body section thickness' of less than about 200 microns, the etching accuracy is greatly diminished for silicon body section thickness' greater than about 200 microns. The gases used for DRIE techniques according to the invention are substantially inert whereas highly caustic chemicals are used for wet chemical etching techniques. The shape of the pressurizing chambers 22 and ink vias 34 made by DRIE is essentially unlimited whereas the shape of chambers and apertures made by wet chemical etching is dependent on crystal lattice orientation. For example in a (100) silicon chip, KOH will typically only etch squares and rectangles without using advance compensation techniques. The crystal lattice does not have to be aligned for DRIE techniques according to the invention.

Methods for deep reactive ion etching (DRIE) are described in U.S. Pat. No. 6,051,503 to Bhardwaj, et al., incorporated herein by reference, in its entirety, as if fully set forth. Useful etching procedures and apparatus are also described in EP 838,839 to Bhardwaj et al., WO 00/26956 to Bhardwaj et al. and WO 99/01887 to Guibarra et al. Etching equipment is available from Surface Technology Systems Limited of Gwent, Wales.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method for making piezoelectric printheads for ink jet printers comprising applying a passivation layer to a first surface of a silicon wafer having a thickness ranging from about 200 to about 800 microns, applying a first conducting layer to the passivation layer on the first surface, applying a piezoelectric layer to the first conducting layer, patterning the piezoelectric layer to provide piezoelectric elements adjacent the first surface of the silicon wafer, applying a second conducting layer to the piezoelectric layer, patterning the second conducting layer to provide conductors for applying an electric field across each of the piezoelectric elements, applying a photoresist layer to a second surface of the silicon wafer, imaging and developing the photoresist layer to provide pressurizing chamber locations, dry etching the silicon wafer through the thickness of the wafer up to the insulating layer on the first surface of the wafer and adhesively bonding a nozzle plate containing nozzle holes corresponding to the pressurizing chambers to the second surface of the silicon wafer, wherein the passivation layer is applied with a thickness ratio of passivation layer to silicon wafer ranging from about 1:10 to about 1:800 based on the thickness of the silicon wafer.

2. The method of claim 1 wherein the pressurizing chambers have a depth ranging from about 190 to about 795 microns.

3. The method of claim 1 wherein the passivation layer and first conducting layer define a diaphragm having a thickness ranging from about 3 to about 10 microns.

4. The method of claim 1 wherein the dry etching is conducted while cycling between an etching plasma and a passivation plasma.

5. The method of claim 4 wherein the etching plasma comprises a plasma derived from a gas selected from the group consisting of sulfur hexafluoride ($SF_6$), tetrafluoromethane ($CF_4$) and trifluoroamine ($NF_3$).

6. The method of claim 5 wherein the etching plasma comprises a plasma derived from $SF_6$.

7. The method of claim 4 wherein the passivation plasma comprises a plasma derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof.

8. The method of claim 7 wherein the passivation plasma comprises a plasma derived from $C_4F_8$.

9. The method of claim 1 wherein the dry etching is selected from deep reactive ion etching (DRIE) and inductively coupled plasma (ICP) etching techniques.

10. The method of claim 1 further comprising dry etching an ink via through the passivation layer and silicon wafer to provide an ink flow path in ink flow communication with the pressurizing chambers.

11. The method of claim 1 further comprising applying a passivation layer to the second surface of the silicon wafer and applying the photoresist layer to the passivation layer.

12. An ink jet printer comprising a printhead made by the method of claim 1.

13. An ink jet printer comprising a printhead made by the method of claim 11.

14. A piezoelectric printhead for an ink jet printer, the printhead comprising a silicon wafer having a thickness ranging from about 200 to about 800 microns, a first surface and a second surface; the first surface of the silicon wafer containing an insulating layer, conducting layer, piezoelectric layer and electrical contact layer and the second surface of the silicon wafer optionally containing a passivation layer, the silicon wafer further including a plurality of pressurizing chambers having substantially vertical walls, the pressurizing chambers being dry etched in the silicon wafer through the optional passivation layer on the second surface up to the insulating layer on the first surface; the printhead further comprising a nozzle plate containing nozzle holes corresponding to each of the pressurizing chambers, the nozzle plate being adhesively attached to the second surface of the silicon wafer, wherein the insulating layer and passivation layer are applied with a thickness ratio of insulating layer and passivation layer to silicon wafer ranging from about 1:10 to about 1:800.

15. The printhead of claim 14 further comprising an ink via in flow communication with the pressurizing chambers, the ink via being dry etched through the silicon wafer, insulating layer and optional passivation layer.

16. The printhead of claim 14 wherein the passivation layer has a thickness ranging from about 0.1 to about 10 microns.

17. The printhead of claim 14 wherein the pressurizing chambers have a depth ranging from about 190 to about 795 microns.

18. An inkjet printer comprising a printhead of claim 14.

19. The printhead of claim 14 wherein the insulating layer and conducting layer define a diaphragm having a thickness ranging from about 3 to about 10 microns.

20. A method for making piezoelectric printheads for ink jet printers comprising applying an insulating layer to a first surface of a silicon wafer having a silicon wafer thickness ranging from about 200 to about 800 microns, applying a photoresist layer to a second surface of the silicon wafer or to an optional passivation layer on the second surface of the silicon wafer, imaging and developing the photoresist layer to provide pressurizing chamber locations, dry etching the silicon wafer through the thickness of the wafer up to the insulating layer on the first surface of the wafer to provide pressurizing chambers, applying a first conducting layer to the insulating layer on the first surface, applying a piezoelectric layer to the first conducting layer, patterning the piezoelectric layer to provide piezoelectric elements adjacent the first surface of the silicon wafer adjacent the pressuring chambers, applying a second conducting layer to the piezoelectric layer, patterning the second conducting layer to provide conductors for applying an electric field across each of the piezoelectric elements, and adhesively bonding a nozzle plate containing nozzle holes corresponding to the pressurizing chambers to the second surface of the silicon wafer or to the optional passivation layer on the second surface of the silicon wafers, wherein the passivation layer and insulating layer are applied with a thickness ratio of passivation layer and insulating layer to silicon wafer ranging from about 1:10 to about 1:800 based on the thickness of the silicon wafer.

21. The method of claim 20 wherein the pressurizing chambers have a depth ranging from about 190 to about 795 microns.

22. The method of claim 20 wherein the dry etching is conducted while cycling between an etching plasma and a passivation plasma.

23. The method of claim 22 wherein the etching plasma comprises a plasma derived from a gas selected from the group consisting of sulfur hexafluoride ($SF_6$), tetrafluoromethane ($CF_4$) and trifluoroamine ($NF_3$).

24. The method of claim 23 wherein the etching plasma comprises a plasma derived from $SF_6$.

25. The method of claim 22 wherein the passivation plasma comprises a plasma derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof.

26. The method of claim 25 wherein the passivation plasma comprises a plasma derived from $C_4F_8$.

27. The method of claim 20 wherein the dry etching is selected from deep reactive ion etching (DRIE) and inductively coupled plasma (ICP) etching techniques.

28. The method of claim 20 further comprising dry etching an ink via through the insulating layer, optional passivation layer and silicon wafer to provide an ink flow path in ink flow communication with the pressurizing chambers.

29. The method of claim 20 wherein the insulating layer and first conducting layer define a diaphragm having a thickness ranging from about 3 to about 10 microns.

* * * * *